343-700 MS AU 256 EX
7/10/79 OR 4,160,976

United States Patent [19]

Conroy

[11] 4,160,976

[45] Jul. 10, 1979

[54] BROADBAND MICROSTRIP DISC ANTENNA

[75] Inventor: Peter J. Conroy, Scottsdale, Ariz.

[73] Assignee: Motorola, Inc., Schaumburg, Ill.

[21] Appl. No.: 859,370

[22] Filed: Dec. 12, 1977

[51] Int. Cl.[2] ..... H01Q 1/38

[52] U.S. Cl. ..... 343/700 MS

[58] Field of Search ..... 343/700 MS, 828, 829, 343/830, 840, 853

[56] References Cited

U.S. PATENT DOCUMENTS

| | | | |
|---|---|---|---|
| Re. 29,296 | 7/1977 | Krutsinger et al. | 343/700 MS |
| 3,680,136 | 7/1972 | Collings | 343/700 MS |
| 4,012,741 | 3/1977 | Johnson | 343/700 MS |
| 4,053,895 | 10/1977 | Malagisi | 343/700 MS |

*Primary Examiner*—Eli Lieberman
*Attorney, Agent, or Firm*—Eugene A. Parsons

[57] ABSTRACT

A broadband antenna including a conductive disc parallel to and spaced from a ground plane with dielectric material therebetween, the disc including a first sector of approximately 270° having a first diameter and the remaining sector having a second diameter different from the first so that the equivalent resonant structure of the antenna is essentially detuned to broaden the bandwidth thereof, and a cylindrical array of such antennas for providing a desired radiation pattern, generally omnidirectional.

11 Claims, 5 Drawing Figures

BROADBAND MICROSTRIP DISC ANTENNA

BACKGROUND OF THE INVENTION

The present invention pertains to a microstrip disc antenna and specifically to a microstrip disc antenna having a relatively broad bandwidth. Microstrip disc antennas typically have a relatively narrow bandwidth, as described in the comprehensive discussion and analysis of microstrip antennas in the periodical *IEEE Transactions on Antennas and Propagations,* January 1975, pages 90–93, entitled "Microstrip Antennas", written by John Q. Howell. Also, a short discussion of the bandwidth is included in the U.S. Pat. No. 3,803,623, entitled "Microstrip Antenna", issued to Lincoln H. Charlot, Jr., on Apr. 9, 1974, in which it is clear that the bandwidth of microstrip disc antennas is relatively small.

SUMMARY OF THE INVENTION

The present invention pertains to a broadband microstrip disc antenna wherein a conductive disc is separated from a ground plane by dielectric material and the conductive disc is formed of a first sector greater than one-half of the disc having a first radius and the remaining sector of the disc has a second radius such that the useful impedance bandwidth of the antenna is increased as much as three times.

It is an object of the present invention to provide a new and improved microstrip disc antenna having a substantially increased useful impedance bandwidth.

It is a further object of the present invention to provide a new and improved broadband microstrip disc antenna which extends the usefulness of circular disc radiators to wider band applications.

It is a further object of the present invention to incorporate the broadband microstrip antenna into a cylindrical array for providing a substantially spherical, or omnidirectional, radiation pattern.

These and other objects of this invention will become apparent to those skilled in the art upon consideration of the accompanying specification, claims and drawings.

BRIEF DESCRIPTION OF THE DRAWINGS

Referring to the drawings, wherein like characters indicate like parts throughout the Figures.

DESCRIPTION OF THE PREFERRED EMBODIMENT

Figure 1:
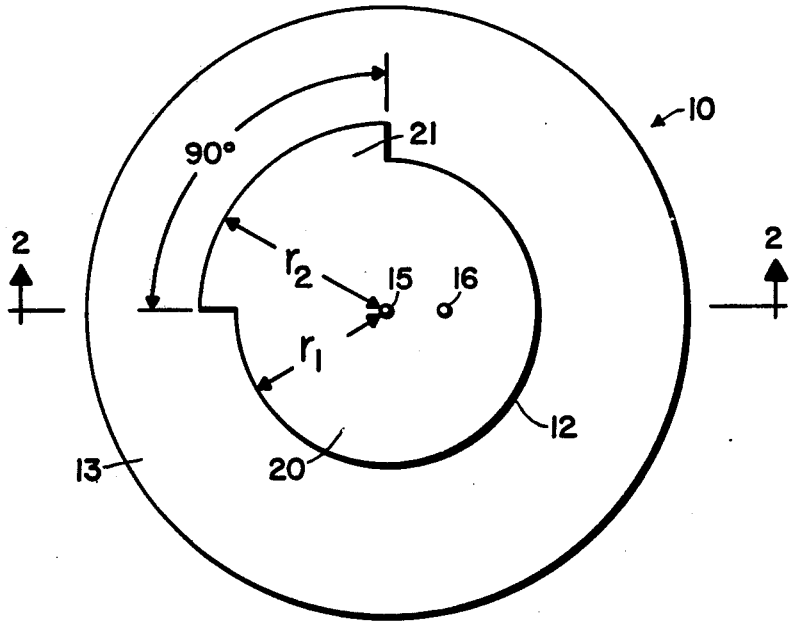
FIG. 1 is a plan view of a broadband microstrip disc antenna embodying the present invention.
Figure 2:
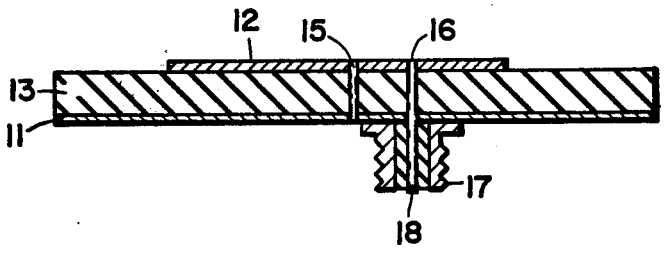
FIG. 2 is a sectional view as seen from the line 2—2 in FIG. 1.

Referring to the Figures, the numeral 10 generally designates a broadband microstrip disc antenna having a ground plane 11 formed of a conductive material such as copper or the like, a conductive disc 12 spaced from the ground plane 11 and dielectric material 13 filling the area between the ground plane 11 and the disc 12. In accordance with standard microstrip disc antenna operation, the disc 12 is electrically connected to the ground plane 11 at the approximate center of the disc 12 by means of a connection 15. Also, the antenna is fed at a point 16 on the disc 12 by means of a coupling device 17 affixed to the rear side of the ground plane 11 and having a center conductor 18 extending through an opening in the ground plane 11 to the disc 12. The ground plane 11 and dielectric material 13 extend radially outwardly a substantial distance beyond the outermost edge of the disc 12 to increase the directional properties of the antenna, but, it should be understood, that the radius of the ground plane 11 and the dielectric material 12 might be equal to the largest radius of the disc 12 if the directional properties of the antenna 10 are not critical or desired.

The disc 12 is constructed with a first sector 20 thereof having a first radius $r_1$ and the remaining sector 21 thereof having a second radius $r_2$. In the embodiment illustrated $r_1$ is smaller than $r_2$, but it should be understood that the remaining sector 21 could have a radius $r_2$ which is smaller than $r_1$. Also, the remaining sector 21 is illustrated as being 90° while the first sector 20 is 270°, but the size of the sectors 20 and 21 and the ratio of the radii $r_1$ and $r_2$ will vary in accordance with the bandwidth desired. Also, the spacing between the ground plane 11 and the disc 12 as well as the type of dielectric material used therebetween will affect the operating characteristics of the antenna 10. While specific formulas for the radii of the sectors 20 and 21 and the size of the sectors 20 and 21, relative to the bandwidth of the antenna 10, would be extremely complicated, it has been found through extensive tests that the operation of the antenna 10 is substantially restricted as the size of the sector 21 becomes larger than 90° and smaller than 60° and as the ratio of the larger of $r_1$ and $r_2$ to the smaller becomes greater than 1.2 to 1.

In the illustrated embodiment, the dielectric material 13 is epoxy glass with a thickness of approximately 0.125 inches, the sector 20 is approximately 270° and the radii of the sectors 20 and 21 are given by the following formulas:

$$r_1 = \frac{.81\,\lambda o}{\pi\sqrt{\epsilon_r}}$$

$$r_2 \simeq \frac{.965\,\lambda o}{\pi\sqrt{\epsilon_r}}$$

where $\lambda o$ = the center frequency of the antenna 10, and $\epsilon_r$ = the dielectric constant of the dielectric material 13. The center frequency $\lambda o$ is equal to 1.814 gigahertz so that the radius of the sector 20 is approximately 0.78 inches and the radius of the sector 21 is approximately 0.98 inches. With a voltage standing wave ratio (VSWR) of two to one, the useful bandwidth of the antenna 10 extends from approximately 1.752 gigahertz to approximately 1.913 gigahertz. This is an increase in bandwidth of approximately three times the bandwidth of a microstrip disc antenna having a radiating disc with a constant radius.

Figure 3:
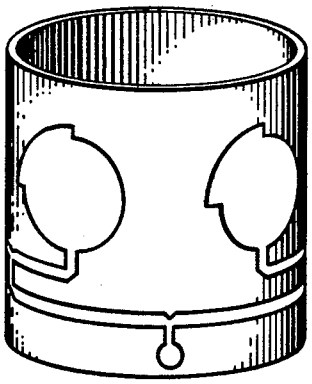
FIG. 3 is a perspective view of an antenna array incorporating a plurality of the disc antennas illustrated in FIG. 1.
Figure 4:
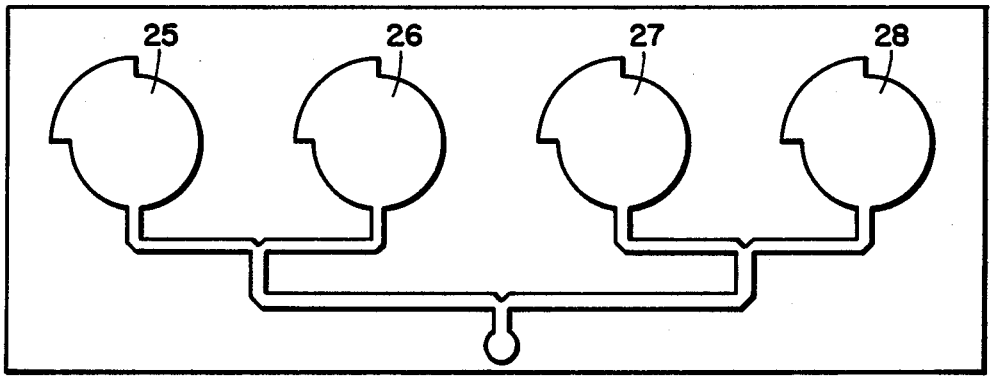
FIG. 4, is a flat plan of the antenna array illustrated in FIG. 3.

Referring specifically to FIGS. 3 and 4, a multiple antenna array is illustrated. In this embodiment, four similar microstrip disc antenna 25–28 are formed in spaced apart relationship and interconnected into an array which provides an omnidirectional radiation pattern. This specific array is constructed by providing a rectangular strip of thin copper material for a ground plane, covering one smooth surface of the copper strip with a dielectric material and placing the four conductive discs 25–28 on the structure so they are separated from the ground plane by the dielectric material, as previously described. The entire structure may be constructed flat, as illustrated by the flat plane of FIG. 4 and, subsequently, formed into the cylinder illustrated in FIG. 3. In this embodiment the leads interconnecting the discs 25–28 are connected to the outer periphery of the discs 25–28 and are adjusted in size to match the impedance, since the impedance of the discs 25–28 is at a maximum at the periphery. The four discs 25–28 are situated so that the third quadrant of each of the discs has a sector (in this embodiment the entire third quadrant) which a radius greater than the remainder of the discs. Each of these sectors is located in approximately the same position in each of the discs so that the radiation from each of the discs is compatible with the other discs to form an omni-directional radiation pattern. It should be understood, of course, that the sector having the different radius might be located in a different quadrant of the discs 25–28, e.g. the first quadrant, but the sectors having the different radius should be located in a similar position in all of the discs.

Figure 5:
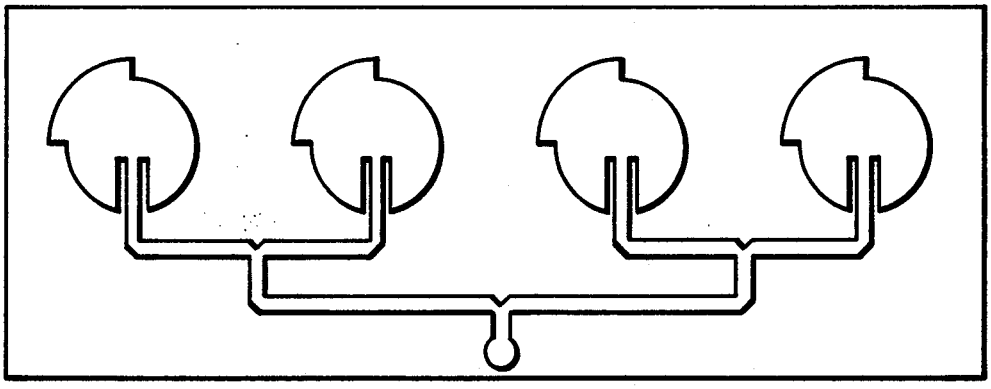
FIG. 5 is a flat plan similar to FIG. 4 of another embodiment.

In FIG. 5 a flat plan of a slightly different antenna array is illustrated. In this embodiment, each of the discs is connected at a point spaced inwardly from the periphery, which has a lower impedance. Portions of the disc immediately adjacent the connecting lead are removed to form a stripline which matches the impedance of the disc antenna to the impedance of the feedline.

While I have shown an embodiment of a broadband microstrip disc antenna which I believe to be nearly optimum and while I have described ranges for different variables in the construction of the antenna which maintain the operation of the antenna near optimum, it should be understood that those skilled in the art might construct a microstrip disc antenna utilizing the present teaching with dimensions outside the suggested ranges and poorer operating characteristics but which operates adequately for a desired purpose. Further, a specific array has been illustrated for an omnidirectional radiation pattern, but other patterns may also be desired. Therefore, I desire it to be understood that this invention is not limited to the particular form shown or the particular ranges described and I intend in the appended claims to cover all modifications which do not depart from the spirit and scope of this invention.

What is claimed is:

1. A broadband microstrip disc antenna comprising:
(a) a ground plane formed of conductive material and providing a smooth surface;
(b) a conductive disc positioned parallel to the smooth surface of said ground plane and spaced therefrom a predetermined distance;
(c) dielectric material positioned between said ground plane and said conductive disc;
(d) said conductive disc being electrically connected to said ground plane at approximately the center of said disc;
(e) a sector greater than one-half of said disc having a first radius;
(f) the remaining sector of said disc having a second radius different than said first radius, and
(g) a feed point on said conductive disc.

2. A broadband microstrip disc antenna as claimed in claim 1 wherein the sector greater than one-half lies in a range of approximately 270° to 240°.

3. A broadband microstrip disc antenna as claimed in claim 1 wherein the first and second radii are in a ratio to each other in a range greater than 1:1 and less than approximately 1.2:1.

4. A broadband microstrip disc antenna as claimed in claim 3 wherein the antenna has a voltage standing wave ratio of approximately 2:1, the first radius is defined by the formula $$(0.81\lambda o)/\pi\sqrt{\epsilon_r}$$

and the second radius is defined by the formula $$(0.965\lambda o)/\pi\sqrt{\epsilon_r}$$

where $\lambda o$ is the wavelength at the center frequency of the antenna and $\epsilon_r$ is the dielectric constant of the dielectric between the disc and the ground plane.

5. A broadband microstrip disc antenna as claimed in claim 4 wherein the center frequency, at the wavelength $\lambda o$ is 1.814 GHz.

6. A broadband microstrip disc antenna as claimed in claim 1 including additional similar disc antennas mounted in an array to provide a predetermined radiation pattern.

7. A broadband microstrip disc antenna as claimed in claim 6 wherein the disc antennas are formed into a cylindrical configuration with the conductive discs on the outer surface thereof and interconnected for providing an onmidirectional radiation pattern.

8. A broadband microstrip disc antenna as claimed in claim 7 wherein the remaining sectors of each of the discs are situated in the same quadrant of the associated disc as all the other remaining sectors.

9. A broadband microstrip disc antenna comprising:
(a) a ground plane formed of conductive material and providing a smooth surface;
(b) a conductive disc positioned parallel to the smooth surface of said ground plane and spaced therefrom a predetermined distance;
(c) dielectric material positioned between said ground plane and said conductive disc;
(d) said conductive disc being electrically connected to said ground plane at approximately the center of said disc;
(e) a sector including approximately 270° of said disc having a radius of approximately $$(0.81\lambda o)/\pi\sqrt{\epsilon_r}$$

and the remaining sector of said disc having a radius of approximately $$(0.965\lambda o)/\pi\sqrt{\epsilon_r}$$

where $\lambda o$ is the center frequency of the antenna and $\epsilon_r$ is the dielectric constant of said dielectric material; and
(f) a feed point on said conductive disc.

10. A broadband microstrip disc antenna as claimed in claim 9 wherein the predetermined distance between the conductive disc and the ground plane is approximately 0.125 inches and the dielectric material is epoxy glass.

11. A broadband microstrip disc antenna as claimed in claim 10 wherein the radius of the 270° sector of the disc is approximately 0.78 inches and the radius of the remaining sector is approximately 0.98 inches.

* * * * *